United States Patent [19]

Fadem

[11] Patent Number: 4,654,650

[45] Date of Patent: Mar. 31, 1987

[54] VOLTAGE OFFSET DEVICE AND METHOD FOR PROVIDING A SMOOTH SCROLL FOR A RASTER SCAN CATHODE RAY TUBE DISPLAY

[75] Inventor: Richard J. Fadem, Roslyn Heights, N.Y.

[73] Assignee: NCR Corporation, Dayton, Ohio

[21] Appl. No.: 696,387

[22] Filed: Jan. 30, 1985

[51] Int. Cl.[4] ..... G09G 1/16

[52] U.S. Cl. ..... 340/726; 340/749

[58] Field of Search ..... 340/726, 723, 749, 748, 340/744

[56] References Cited

U.S. PATENT DOCUMENTS 3,611,348 10/1971 Rogers ..... 340/726

4,160,981 7/1979 Raney, Jr. ..... 340/726

*Primary Examiner*—Marshall M. Curtis

*Attorney, Agent, or Firm*—Wilbert Hawk, Jr.; Edward Dugas; Floyd A. Gonzalez

[57] ABSTRACT

A device and method for providing a smooth scroll of a display on a cathode ray tube display device having a display area, horizontal deflecting means receiving horizontal drive pulses for effecting horizontal scans, vertical deflecting means receiving vertical drive pulses for moving said video display vertically, and a video input for receiving a video input signal. The device includes a microprocessor having an input and an output. The microprocessor counts, and places on its output, digital signals corresponding to its count. A digital-to-analog converter converts the digital signals to an analog signal. A summing device is connected between the digital-to-analog converter output and the vertical deflecting means of the cathode ray tube display device for summing a vertical deflection pulse and the analog signal output of said digital-to-analog converter, thereby vertically displacing the video input signal of the cathode ray tube display device.

12 Claims, 8 Drawing Figures

FIG. 4
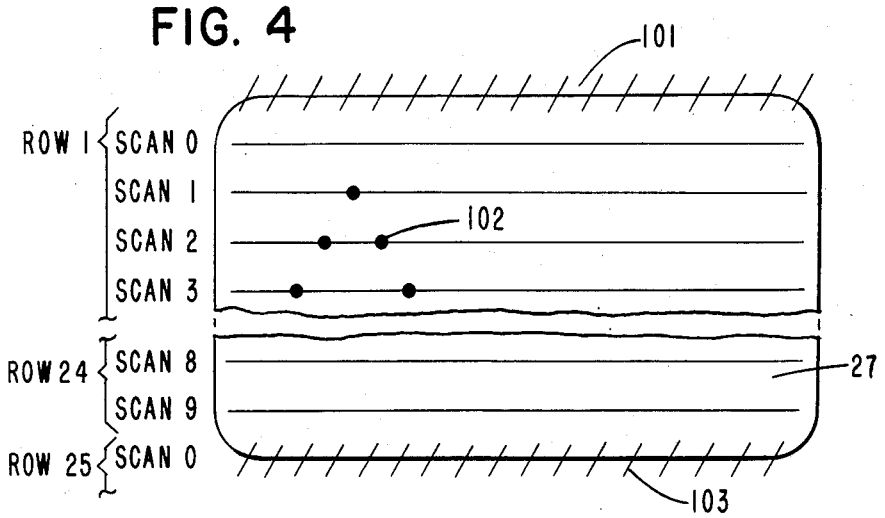
FIG. 5
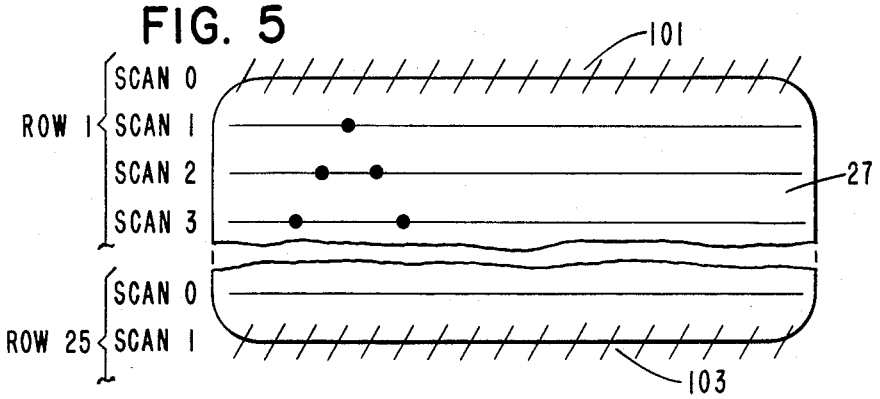
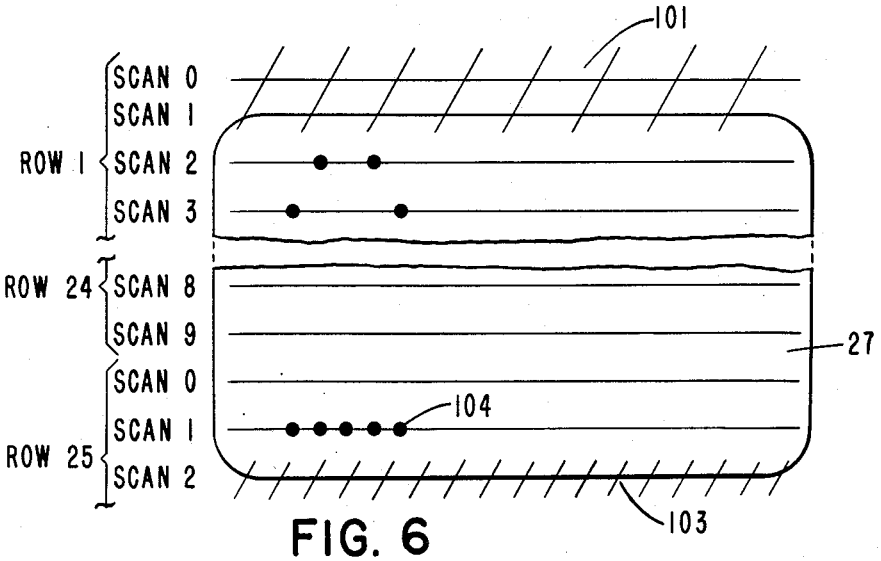
FIG. 6

VOLTAGE OFFSET DEVICE AND METHOD FOR PROVIDING A SMOOTH SCROLL FOR A RASTER SCAN CATHODE RAY TUBE DISPLAY

BACKGROUND OF THE INVENTION

The present invention relates generally to cathode ray tube (CRT) display devices, and more particularly to an apparatus and method for providing smooth scrolling in CRT display devices.

One of the display devices usable with digital transmission and display systems such as computers, is the CRT display device. These display devices are typically connected to a memory in which the data to be displayed are stored. The data are either stored wherein each picture element or pixel is represented by a bit, or wherein a coded representation is stored and then decoded prior to being displayed. The display is changed by changing in memory the data to be displayed, and then displaying the changed data. In these devices, the changes, including scrolling, are effected by digital means in the memory prior to display.

Patents of interest which disclose these and other similar apparatus are: U.S. Pat. No. 4,068,225 to Lee; U.S. Pat. No. 3,988,728 to Inoue et al; U.S. Pat. No. 4,019,090 to Wolff et al; U.S. Pat. No. 4,437,093 to Bradley; U.S. Pat. No. 3,787,833 to Rogers; U.S. Pat. No. 3,593,310 to Kievit; U.S. Pat. No. 3,706,075 to Fredrickson et al; U.S. Pat. No. 3,680,077 to Hoberecht; U.S. Pat. No. 4,196,430 to Denko; and U.S. Pat. No. 4,129,859 to Iwamura et al.

U.S. Pat. No. 4,301,393 to Shoji et al. discloses a Y-axis offset system for a cathode ray tube which uses a counter and a digital-to-analog converter to generate an offset voltage to automatically position a trace in a viewing area on the cathode ray tube face.

SUMMARY OF THE INVENTION

In the present invention, at least the number of rows of characters to be displayed plus one, are stored in a memory. The displayed rows are scrolled smoothly by adding an offset voltage to the vertical drive pulse, thereby offsetting each scan line of the rows being displayed such that all of the scan lines in a display are offset in the scrolled direction. The offset voltage is held for a period of a selected number of frames before being incrementally increased to move all of the scan lines another increment in the scrolled direction. In one preferred embodiment, the offset voltage is generated by counting from the initiation of the smooth scroll, and holding the count for the duration of a select number of frames. A digital-to-analog converter converts the count to an analog voltage to move the display in the scrolling direction for each increase in count. The count may be incremented at the start of the fast vertical drive pulse of each frame period.

The count is increased until all of the scan lines in a first row are thus scrolled, at which time the count is reset and the memory is indexed to reference the next row of characters to be displayed. Blanking is synchronized such that the scan line scrolled out of the viewing area is blanked, and the scan line scrolled into the viewing area is unblanked.

In one preferred embodiment, a device is disclosed for providing a smooth scroll of a display on a cathode ray tube display device having a display area, horizontal deflecting means receiving horizontal drive pulses for effecting horizontal scans, vertical deflecting means receiving vertical drive pulses for moving said video display vertically, and a video input for receiving a video input signal. The device includes a microprocessor having an input and an output. The microprocessor counts, and places on its output, digital signals corresponding to its count. A digital-to-analog converter is included which has an input connected to the output of the microprocessor and an output. The digital-to-analog converter converts the digital signals to an analog signal. A summing device is connected between the digital-to-analog converter output and the vertical deflecting means of the cathode ray tube display device for summing a vertical deflection pulse and the analog signal output of said digital-to-analog converter, thereby vertically displacing the video input signal of the cathode ray tube display device. A synchronizing device is connected to the microprocessor and the video input of said cathode ray tube display device. The synchronizing device synchronizes the incrementing of the microprocessor such that the count of the microprocessor changes in response to a selected vertical drive pulse, and blanks the video signal such that the video signal vertically displaced out of said viewing area is blanked, and the video signal vertically displaced into said viewing area is unblanked.

It is thus an object of the present invention to disclose an apparatus and method for providing a smooth scroll wherein the smooth scroll is effected by applying a voltage offset to the vertical deflection means of a cathode ray tube display device.

It is also an object to disclose an apparatus and method for providing a smooth scroll wherein the smooth scroll is accomplished by analog techniques.

It is a further object to disclose an apparatus and method in which a smooth scroll is synchronized by a count which is initiated by selected vertical pulse, and wherein the count is converted to a vertical offset voltage by a digital-to-analog converter.

BRIEF DESCRIPTION OF THE DRAWINGS

FIG. 4 is a diagrammatic illustration of a display on the CRT display device of FIG. 1, including blanking;

FIG. 5 is a diagrammatic illustration of the display of FIG. 4 scrolled one scan line upwardly;

FIG. 6 is a diagrammatic illustration of the display of FIG. 4 scrolled two scan lines upwardly;

DESCRIPTION OF THE PREFERRED EMBODIMENT

Figure 1:
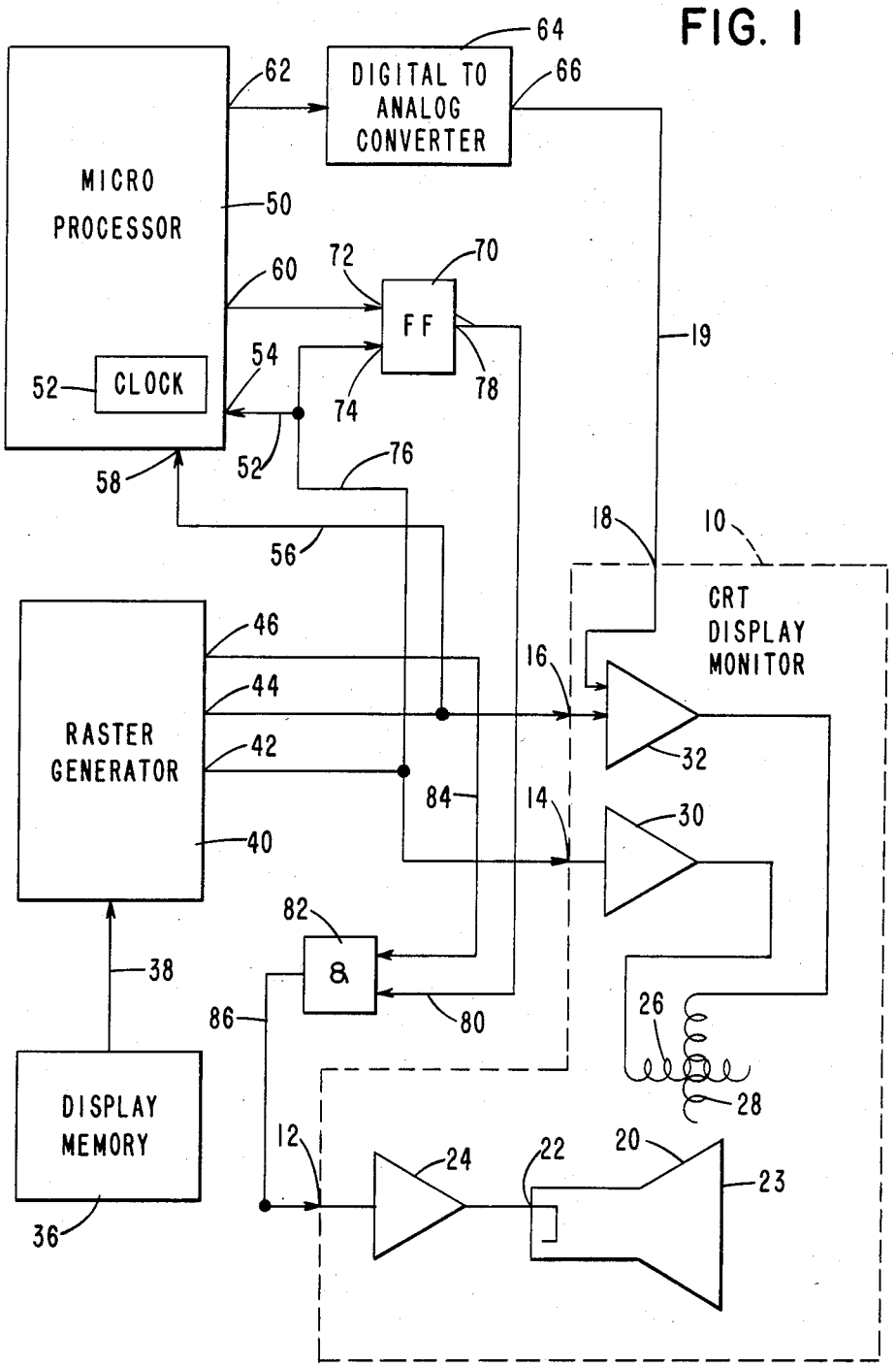
FIG. 1 is a schematic diagram showing one embodiment of the present invention having a CRT display device.

FIG. 1 is a block diagram of a CRT display monitor system usable with the present invention. The system includes a CRT display monitor 10 having a video input 12, a horizontal drive input 14, a vertical drive input 16, and a vertical offset voltage input 18.

The CRT display monitor includes a cathode ray tube 20, whose cathode 22 is connected to the output of a video amplifier 24 which amplifies video input signals received from the video input 12 of the display monitor 10.

The sweep of an electron beam from the cathode 22 across the screen 23 of the cathode ray tube 20 is controlled by deflection coils 26 and 28, in a well-known manner. Deflection coil 26 controls the horizontal deflection of the electron beam, and is connected to the horizontal deflection amplifier 30 which amplifies horizontal drive signals received by terminal 14 of the CRT display monitor. The vertical deflection coil 28 controls the vertical deflection of the electron beam, and is connected to a vertical deflection amplifier 32 which amplifies vertical drive signals received by the vertical drive input terminal 16 of the CRT display monitor. A DC coupled offset voltage is input at 18 from vertical offset voltage conductor 19 to the vertical deflection amplifier 32 as shown. The offset voltage input to amplifier 32 at 18 is a DC voltage which causes the display to be moved in the vertical direction in proportion to its value and polarity, as will be discussed.

The system includes a display memory 36 which holds the electrical representation of the number of rows of text to be displayed on the CRT screen 23, plus one additional row of text. The text of the data stored in the display memory 36 may be placed there in any one of a number of well known schemes, such as by use of a computer or data processing system. The storing of data in the display memory 36, and the updating and sequential movement of data in display memory 36 is well understood and will not be further discussed. The display memory 36 is connected by a data connection represented by line 38 to a raster generator circuit 40.

The raster generator circuit 40 has a horizontal drive signal output 42, a vertical drive signal output 44, and a video signal output 46. The horizontal drive signal output at 42 by the raster generator circuit 40 is a normal horizontal raster drive signal of a linear saw-tooth current wave form for providing for a horizontal sweep operation of the CRT 20. Also, the raster generator outputs a vertical drive signal at 44 which is a normal vertical raster drive signal of a linear saw-tooth current wave form for providing for a vertical sweep of the CRT 20.

A microprocessor 50 is provided which is controlled by a clock circuit 52. Horizontal drive pulses are input over conductor 52 to an input port 54 of the microprocessor 50, and vertical drive pulses are input over conductor 56 to a second input port 58 of the microprocessor 50. The vertical drive pules from conductor 56, and the horizontal drive pulses from conductors 52 are used to synchronized blanking with the raster generator, as will be explained.

The microprocessor 50 outputs blanking pulses at output port 60 and a numeric value at output port 62. A digital-to-analog converter 64 is connected to the output port 62, and has its analog voltage output 66 connected to the vertical offset voltage input 18 over conductor 19, which is, in turn, connected to the vertical amplifier 32 of the display monitor 10.

A synchronization flip-flop 70 has a first input 72 connected to the blanking signal output 60 of the microprocessor 50, and a second input 74 connected by conductor 76 to the horizontal drive output 42 of the raster generator 40. The inverse output 78 of the synchronization flip-flop 70 is connected by conductor 80 to one input of an AND gate 82, and the other input of the AND gate 82 is connected by conductor 84 to the video output 46 of the raster generator 40. The output of the AND gate 82 is connected to the video input terminal 12 of the CRT display monitor 10 by conductor 86.

As will be explained in connection with FIGS. 2–7, the display to be scrolled is composed of a number of scan lines in which each scan line is scanned horizontally across the screen by horizontal drive pulses input at terminal 14. One vertical scan in which the screen 23 is filled with text, takes place over one vertical drive pulse, referred to herein as one frame. The complete vertical scroll of one row of text takes place over a scroll duration which is divided into equal time periods wherein one scan line in scrolled vertically at the beginning of each time period. Each time period may contain a select number of frames, for example, one to four frames, such the the entire display is moved vertically one scan line, and then held there for the select number of frames. The entire display is then scrolled one more scan line, and held there, and so forth.

The number of frames in a time period are selected such that vertical scroll will appear smooth to the eye. Hereinafter, each time period is discussed as if it contains only one frame, but it will be understand that each time period may contain more frames, as desired, to give a smooth appearing scroll without an intermittent appearing movement.

Returning to FIG. 1, a vertical scroll is initiated by a signal to the microprocessor 50 from an appropriate source, such as by depressing a key on a keyboard (not shown). At the beginning of the next vertical pulse appearing at 50, the numeric value of one will appear on output port 62 to be converted by the digital-to-analog converter to 64 to an offset voltage. This will cause the text displayed on screen 23 to be scrolled vertically, moving one scan line of text out of the viewing area. The microprocessor 50 outputs a high blanking signed at terminal 54, which sets the flip/flop 70, making output 78 go low. This low is transmitted over Conductor 80 to one input of the AND gate 82.

The next horizontal pulse over conductor 76 resets flip/flop 70 such that its output 78 goes high, thereby, unblanking the video signed on terminal 46. The blanking signal on 60 has, in the mean time, been returned to a low. The microprocessor then counts the horizontal pulses to determine when the first scan line of the hidden row has moved into the viewing area of screen 23. After the first scan line has been displayed, the microprocessor again raises the blanking signal on terminal 60.

At the beginning of the first vertical pulse in the next time frame, the numeric value on output terminal 62 is incremental to a two, thus vertically moving the text on the screen two scan lines. In this case, the blanking signal on terminal 60 would be raised for two horizontal drive pulse, and would be held low for a sufficient number of drive pulses to unblank two scan lines of the hidden row which have been scrolled into the viewing area of the screen 23.

Thus, the microprocessor 50 of FIG. 1 synchronizes the blanking signal with both the vertical drive pulses and the horizontal driver pulses as described. Which of the scan lines are to be blanked is determined by counting the horizontal drive pulses appearing on terminal 54 after the beginning of the first vertical drive pulse on terminal 58. The numeric value on output port 62 is incremented by one at the beginning of the first vertical drive pulse of each mentioned time period, until the entire initially hidden row has been vertically scrolled into the viewing area of the screen 23.

It will be understood that the clock 52 could be used to time when the blanking signal is turned on and off. If this were done, flip/flop 70 would not be needed.

Figure 2:
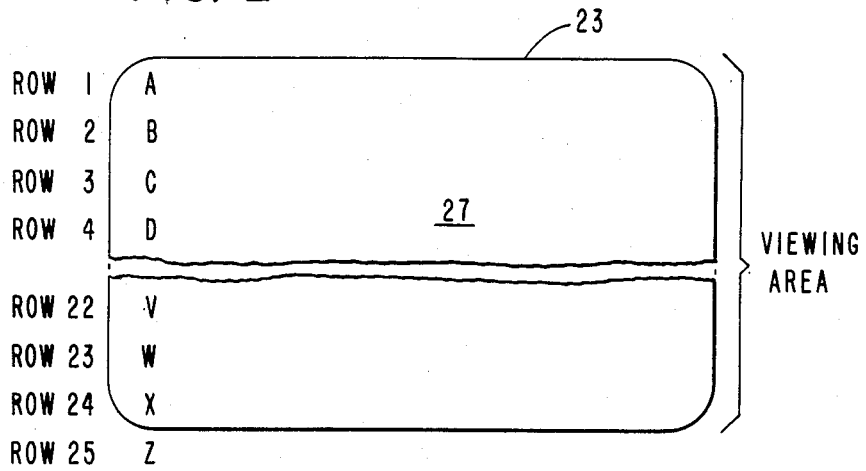
FIG. 2 is a diagrammatic illustration of the viewing area of the CRT display device of FIG. 1.

FIG. 2 is a diagrammatic illustration of viewing area 27 of the CRT screen 23 of FIG. 1. The viewing area 27 has room to display a plurality of rows, illustrated in FIG. 2 as twenty-four rows. The first characters shown in the example illustrated in FIG. 2 is a letter shown in alphabetical order for rows 1–24. Hidden row 25, which is blanked as explained, starts with a "Z" as shown. It will be understood that the rows may contain a number of vertically aligned character positions, such as for example 40, in which additional characters may be displayed.

Figure 3:
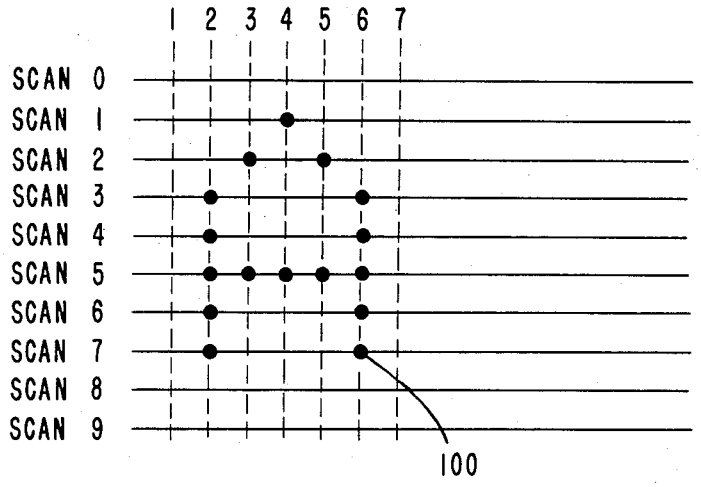
FIG. 3 is a diagrammatic illustration of the first character position of a normal display on the CRT display device of FIG. 1.

FIG. 3 is an enlarged illustration of the first character in the first character position of row 1. As shown, each row contains a number of scan lines, illustrated in FIG. 3 as 10 numbered 0–9. The character is divided into seven columns, numbered 1–7. The scan lines and the columns thus divide the character into a seven by ten block of picture elements or pixels 100 which may be illuminated in various configurations to form a character, such as the character A illustrated in FIG. 3. It will be understood that the number of scan lines and the number of columns shown in FIG. 3 is exemplary only, and that the number of scan lines and columns may be varied as desired.

The display memory 36 of FIG. 1 may be divided such that each bit represents a pixel in the 25 rows of text, or the characters to be displayed may be stored as binary representations, and a table look-up routine may be used for each character to determine the pixels to be illuminated for each character, and for formulating an entire scan line. Such display memory schemes and their conversion to video signals are well known in the art and will not be further described herein.

FIG. 4 is a segmented view of the viewing area 27 of the screen 23 which shows a portion of the top row, row 1, and a portion of the bottom row, row 24, which appears in a normal display on screen 23. The video signal is blanked, as shown at 101, until scan line 0 of row 1 is to be displayed. After blanking at 101, the video signal is unblanked and scan line 0 is displayed. At the end of scan line 0, scan line 1 is displayed, and then scan line 2, and so forth. In the example illustrated, the pixels of the scan lines 0–9 of the first character of row 1 are illuminated such that the character A is formed, the top portion of which is shown at 102. Dropping to the bottom of the viewing area 27, scan lines 8 and 9 of row 24 are shown. In the example of FIG. 4, none of the pixels of these rows are illuminated. After row 24, all of the scan lines of hidden row 25 are blanked as shown at 103.

FIG. 5 is a diagrammatic illustration of the viewing area 27 after scan line 0 of the top row has been scrolled upwardly. It will be seen that the scan line 0 of the first character of the first row has moved into the blanked area 101, and the remaining scan lines have moved upwardly as shown. At the bottom of the viewing area 27, scan line 0 of row 25 has moved out of the blanked area 103 into the viewing area 27.

FIG. 6 is a diagrammatic illustration similar to FIG. 5 wherein the display initially in the viewing area 27 has moved upwardly b 2 scan lines. It will be seen that scan lines 0 and 1 of row 1 have moved into the blanked area 101 at the top of the viewing area 27, and that scan lines 0 and 1 of hidden row 25 have moved out of the blanked area 103 and into the viewing area 27. It will be noted that the pixels 104 of scan 1 in the first character of row 25 have been illuminated to form the top line of the character Z, which is the first character in row 25 as shown in FIG. 2.

Figure 7:
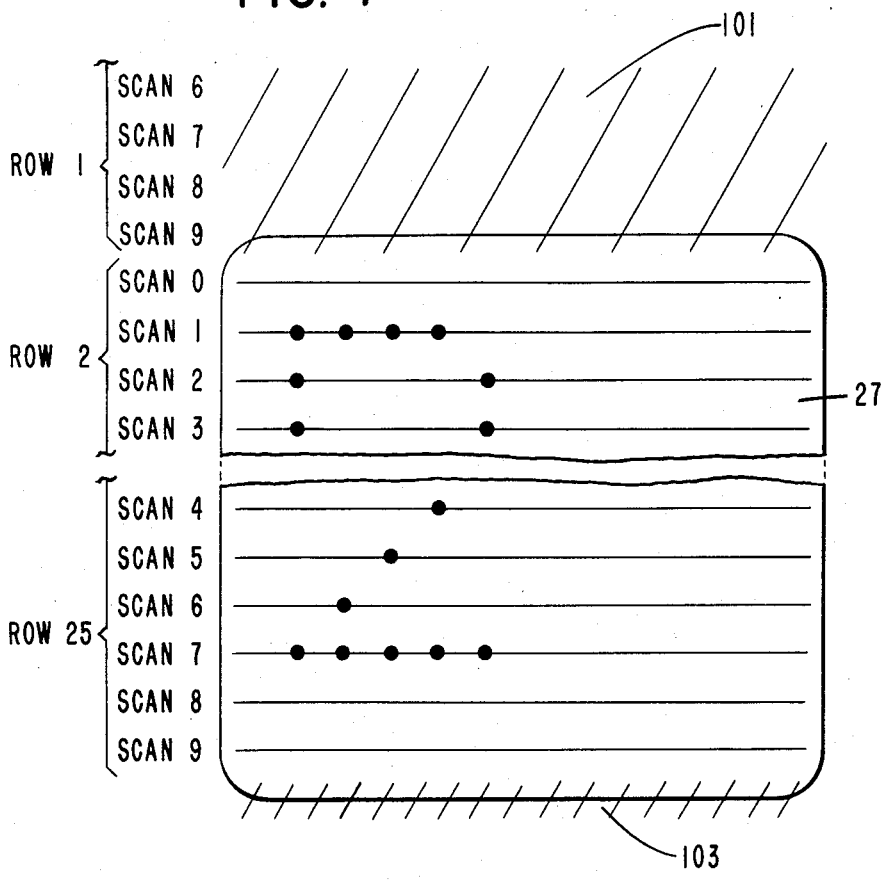
FIG. 7 is a diagrammatic illustration of the display of FIG. 4 scrolled a full row of ten scan lines upwardly.

FIG. 7 is a diagrammatic illustration of the display in the viewing area 27 after row 1 has been entirely scrolled upwardly. It will be seen that all of the scan lines 0 through 9 of row 1 have been moved into the blanked area 101, and that scan line 0 of row 2 has become the first scan line in the viewing area. Also, all of the scan lines 0–9 of row 25 have moved completely out of the blanked area 103 into the bottom row of the viewing area 27.

If a circulating memory is used in the display memory 36 of FIG. 1, at the end of the scrolling up, row 2 becomes row 1, row 3 becomes row 2, and so forth, with row 25 becoming row 24. However, it is not necessary for the text in the rows to be physically moved, but that a new row 25 be written over old row 1, and that the index for the rows be changed such that row 2 becomes row 1, and so forth. It is thus only necessary to keep track of where row 1 is located in the display memory, rather than physically moving the text around in the memory.

Figure 8:
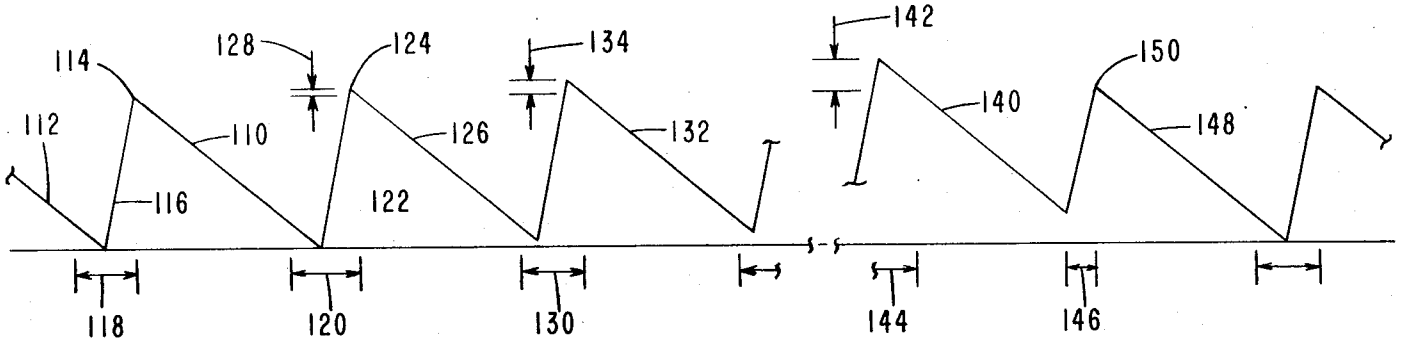
FIG. 8 illustrates the waveform of the vertical pulse train during smooth scrolling.

FIG. 8 is an illustration of a fragmented portion of the wave form of the vertical pulse train during smooth scrolling. Sawtooth 110 of the vertical pulse train 112 represents a normal display on the screen as illustrated in FIGS. 2 and 4. It will be understood that at the peak 114 of the sawtooth 110, the beam will be positioned at column 1 of scan line 0 of row 1, as explained in connection with FIG. 3. It will also be understood that as the amplitude of the sawtooth 110 decreases, the beam position will move downwardly on the screen until scan line 9 of row 24, shown in FIGS. 2 and 4, has been completed.

As shown in FIG. 8, sawtooth 110 includes a flyback portion 116 to return the beam position from the bottom of the screen of the immediately preceding vertical pulse, to the top of the screen for sawtooth 110. As illustrated at 118, blanking is on during row 25 of the immediately preceding vertical pulse, and during the flyback portion 116. When the beam is positioned at the start of scan line 0 of row 1, blanking is turned off. When scan line 0 of row 25 of sawtooth 110 is reached, blanking is again turned on, as shown at 120.

It will be understood that blanking can be turned on and off by counting the horizontal drive pulses, or by a timer that starts at the beginning of each display and times the entire display before turning blanking on, or by a voltage detector which detects the voltage level of the vertical pulse for voltages within the viewing area.

It will be understood that even though the sawtooth 110 has a falling amplitude during the vertical pulse, the sawtooth 110 could have a rising amplitude depending upon the design of the CRT display monitor 10, and its deflection coil 28 shown in FIG. 1.

Returning to FIG. 8, when smooth scrolling is initiated, a vertical offset 128 is added to the wave during the flyback portion 122 such that at the peak 124 of sawtooth 126, the beam position at the beginning of scan line 0 of row 1 is one scan line increment above where it was in sawtooth 110.

Blanking, illustrated by the horizontal line at 120, is held on for an additional horizontal drive pulse, allowing the beam position to move one scan line down and back into the viewing area of the screen. Also, the blanking at 130 is held off for one additional horizontal pulse to allow scan line 0 of row 25, which has moved upwardly into the viewing area, to be unblanked. This is shown in FIG. 5.

Sawtooth 132 illustrates adding a second increment to the vertical offset 134 to move the display two scan lines upwardly. This is shown in FIG. 6.

Although FIG. 8 only shows holding each increment for only one vertical drive pulse, or one frame, it will be understood that the microprocessor may be programmed for holding each increment for more frames, such as from one to four frames, to make the scroll appear smoother.

Sawtooth 140 of FIG. 8, shows a vertical offset 142 sufficient to move all nine scan lines of row 1 out of the viewing area. In this case, blanking at 144 is not turned off until the beginning of scan line 0 of row 2, which now has moved to the top of the viewing area. Blanking at 146 is not turned on until after the end of scan line 9 of row 25, thereby unblanking all of row 25. This is shown in FIG. 7.

At the end of sawtooth 140, the display memory 36 of FIG. 1 has been rotated such that row 2 becomes row 1, row 3 becomes row 2, and so forth, and a new row 25 is placed in memory. Also, the offset is removed from the vertical pulse so that the sawtooth 148 becomes normal. Thus, blanking 146 is turned off at the peak 150 of sawtooth 148. Without an offset, scan line 0 of the new row 1 will again be at the top of the viewing area as shown in FIGS. 2 and 4. Smooth scrolling may then be initiated as before.

A smooth scroll in both vertical directions could be provided by adding an additional row of text in the display memory which can be called row 0, and providing a second digital-to-analog converter for providing a vertical offset voltage of the opposite polarity. One digital-to-analog converter would move the scan lines upwardly, and one digital-to-analog converter would move the scan lines downwardly.

An apparatus has thus been described for providing a voltage offset technique for a smooth scroll on a raster scan CRT display. The described apparatus, and its components, are exemplary only and may be replaced by equivalents by those skilled in the art, which equivalents are intended to be covered by the attached claims.

What is claimed is:

1. A device providing a smooth scroll of a video display divided into a set number of rows, each row being divided into a set number of scan lines, said device comprising:

a cathode ray tube display device having a display area, horizontal deflecting means receiving horizontal drive pulses for effecting horizontal scans such that a separate scan line is displayed by each horizontal drive pulse, vertical deflecting means receiving vertical drive pulses for moving said video display vertically, and video input means for receiving a video input signal;

counting means having an input and an output, said counting means for counting and placing on its output, digital signals corresponding to the count of said counting means said counting means incrementing its count at the start of selected vertical drive pulses, and includes means to provide a blanking signal, said blanking signal stopping blanking after the point wherein the number of horizontal drive pulses received on said counting means input after the beginning of said selected vertical drive pulse is equal to the count of said counting means, and said blanking signal further starting blanking after the point wherein the number of horizontal drive pulses received on the counting means input after the last scan line to be normally displayed is equal to the count of said counting means;

a digital-to-analog converter having an input and an output, said output being connected to the output of said counting means, said digital-to-analog converter for converting the digital signals to an analog signal;

summing means connected between said digital-to-analog converter output and the vertical deflecting means of said cathode ray tube display device for summing a vertical deflection pulse and the analog signal output of said digital-to-analog converter, thereby vertically displacing the video input signal of said cathode ray tube display device; and synchronizing means connected to said counting means and the video input means of said cathode ray tube display device, said synchronizing means providing said vertical drive pulses and said horizontal drive pulses to the input of said counting means for synchronizing the incrementing of said counting means such that the count of said counting mean changes in response to a selected vertical drive pulse, and said synchronizing means further receiving said blanking signal from said counting means for blanking of said video signal such that the video signal vertically displaced out of said viewing area is blanked, and the video signal vertically displaced into said viewing area is unblanked.

2. The device of claim 1 wherein the vertical displacement of said summing means is an upward displacement.

3. The device of claim 2 wherein the numeric value of the digital signals of said counting means is held for a set number of frames.

4. The device of claim 3 wherein said set number of frames is from approximately one frame to approximately four frames.

5. The device of claim 2 wherein said counting means starts at one, and the maximum numeric value of the digital data of said counting means is equal to the number of scan lines in a row.

6. The device of claim 2 further comprising memory means for storing said video display plus at least one row, said memory means including transmission means for transmitting said video display as a video signal from said memory means to said video input means of said cathode ray tube display device.

7. A method for providing a smooth scroll of a video display on a cathode ray tube displaying device having a display area, horizontal deflecting means for receiving horizontal drive pulses for effecting horizontal scans, vertical deflecting means for receiving vertical drive pulses for moving said video display vertically, and video input means for receiving a video input signal, said video input signal being blanked during a portion of the vertical deflection of said vertical deflection means from a defined end position of said display area to a defined beginning position of said display area said video display being divided into a set number of rows, each row being divided into a set number of scan lines, a separate scan line being displayed by each horizontal drive pulse, said method comprising the steps of:

counting and providing digital signals corresponding to the count of said counting;

converting the digital signals to an analog signal;

summing a vertical deflection pulse and said analog signal, thereby providing a summed signal;

placing the summed signal on the deflecting means of said cathode ray tube display device, thereby vertically displacing the video input signal of said cathode ray tube display device;

synchronizing the incrementing of said counting step such that the count of said counting step changes in response to a selected vertical drive pulse, and the blanking of said video signal such that the video signal vertically displaced out of said viewing area is blanked, and the video signal vertically displaced into said viewing area is unblanked; and stopping blanking after the point wherein the number of horizontal drive pulses after the beginning of said selected vertical drive pulses is equal to the count of said counting step, and starting blanking after the point wherein the number of horizontal drive pulses after the last scan line to be normally displayed is equal to the count of said counting step.

8. The method of claim 7 wherein the vertical displacement is an upward displacement.

9. The method of claim 8 further comprising holding the numeric value of the digital signals of said counting means for a set number of frames.

10. The method of claim 9 wherein said set number of frames is from approximately one frame to approximately four frames.

11. The method of claim 7 wherein said counting step starts at one, and the maximum value of said counting step is equal to the number of scan lines in a row.

12. A device providing a smooth scroll of a display comprising:

a cathode ray tube display device having a display area, horizontal deflecting means receiving horizontal drive pulses for effecting horizontal scans, vertical deflecting means receiving vertical drive pulses for moving said video display vertically, and video input for receiving a video input signal;

video signal memory means for storing a video display for filling the display area of said cathode ray tube plus at least one line;

transmission means for transmitting a video signal from said video signal memory means to the video input of said cathode ray tube display device;

a raster generator for generating said horizontal drive pulses and said vertical drive pulses;

a microprocessor having a first input port for receiving said horizontal drive pulses, and a second input port for receiving said vertical drive pulses, a first output port for outputting a digital count signal, and a second output port for outputting a blanking signal;

a digital-to-analog converter for converting said digital count signal to an analog offset signal;

summing means having a first input connected for receiving said vertical drive pulses, a second input for receiving said analog offset signal, and an output connected to said vertical deflecting means, said summing means summing said vertical drive pulses and said analog offset signal for vertically displacing said video display responsive to the magnitude and polarity of said analog offset voltage;

synchronizing means having an input for receiving the blanking signal from said microprocessor, and including a blanking means for blanking said video signal responsive to said blanking signal inputted to said synchronizing means; and said microprocessor increments its count at the beginning of selected vertical pulses, and outputs a blanking signal responsive to selected horizontal pulses such that that portion of the video signal displaced out of said viewing area responsive to said analog offset voltage is blanked, and that portion of the video signal displaced into said viewing area responsive to said analog offset voltage is not blanked.

* * * * *